US012606337B2

(12) United States Patent
Tan

(10) Patent No.: US 12,606,337 B2
(45) Date of Patent: Apr. 21, 2026

(54) PACKING APPARATUS AND ITS METHOD FOR LOADING ARTICLES INTO PACKAGING

(71) Applicant: SKY-TAG ROBOTICS SDN. BHD., Simpang Ampat (MY)

(72) Inventor: Cheow Heng Tan, Georgetown (MY)

(73) Assignee: SKY-TAG ROBOTICS SDN. BHD., Simpang Ampat (MY)

( * ) Notice: Subject to any disclaimer, the term of this patent is extended or adjusted under 35 U.S.C. 154(b) by 0 days.

(21) Appl. No.: 18/133,677

(22) Filed: Apr. 12, 2023

(65) Prior Publication Data

US 2024/0182196 A1 Jun. 6, 2024

(30) Foreign Application Priority Data

Dec. 1, 2022 (MY) ..... PI2022006759

(51) Int. Cl.

| | |
|---|---|
| ***B65B 43/46*** | (2006.01) |
| ***B65B 5/06*** | (2006.01) |
| ***B65B 35/50*** | (2006.01) |
| ***B65B 63/02*** | (2006.01) |

(52) U.S. Cl.

CPC ..... *B65B 43/46* (2013.01); *B65B 5/06* (2013.01); *B65B 35/50* (2013.01); *B65B 63/02* (2013.01)

(58) Field of Classification Search

CPC ..... B65B 31/025; B65B 5/06; B65B 7/20; B65B 7/26; B65B 35/36; B65B 43/52

See application file for complete search history.

(56) References Cited

U.S. PATENT DOCUMENTS

| | | | | | |
|---|---|---|---|---|---|
| 2,923,112 | A * | 2/1960 | Harker | B65B 7/20 | 53/376.5 |
| 3,022,615 | A * | 2/1962 | Schroeder | B65B 61/02 | 53/496 |
| 3,139,714 | A * | 7/1964 | Hall | B65B 5/061 | 53/529 |
| 4,067,172 | A * | 1/1978 | Paules | B65B 59/00 | 53/506 |
| 4,517,791 | A * | 5/1985 | Focke | B65B 5/06 | 198/374 |
| 4,870,807 | A * | 10/1989 | Palamides | B65B 27/08 | 53/529 |
| 5,175,976 | A * | 1/1993 | Petry | B65B 39/12 | 53/566 |
| 6,202,392 | B1 * | 3/2001 | Greenwell | B65B 25/141 | 53/566 |
| 7,360,344 | B2 * | 4/2008 | White | B65B 61/12 | 53/529 |

(Continued)

*Primary Examiner* — Stephen F. Gerrity
*Assistant Examiner* — Katie L Gerth
(74) *Attorney, Agent, or Firm* — Preston Smirman; SMIRMAN IP LAW, PLLC

(57) ABSTRACT

A packing apparatus and its corresponding method for loading articles, having been arranged into a stack (4), into a packaging (5). The apparatus includes a carrying means (11) for carrying the stack (4), and a compressing means (12) for collecting the stack (4) from the carrying means (11) and transferring the stack (4) into the packaging (5) through an open end of the packaging (5). The compressing means (12) is further adapted to compress the stack (4) for sizing it sufficiently, so that the stack (4) is loaded into the packaging (5) together with the compressing means (12).

8 Claims, 5 Drawing Sheets

(56) References Cited

U.S. PATENT DOCUMENTS

| | | | | |
|---|---|---|---|---|
| 8,650,842 | B2 | 2/2014 | Stollery et al. | |
| 11,377,248 | B2 * | 7/2022 | Moncrief | B65B 5/024 |
| 11,713,148 | B2 * | 8/2023 | Rapparini | B65B 43/265 53/456 |
| 2015/0329231 | A1 * | 11/2015 | Moncrief | B65B 59/001 53/543 |
| 2016/0176561 | A1 * | 6/2016 | Findlay | B65G 47/90 53/235 |
| 2019/0263547 | A1 * | 8/2019 | Tatsukawa | B65B 7/2864 |
| 2019/0322066 | A1 * | 10/2019 | Engelhardt | B65B 35/405 |
| 2022/0081136 | A1 * | 3/2022 | Engelhardt | B65B 35/50 |
| 2024/0101290 | A1 * | 3/2024 | Tan | B65B 7/20 |

* cited by examiner

PACKING APPARATUS AND ITS METHOD FOR LOADING ARTICLES INTO PACKAGING

CROSS-REFERENCE TO RELATED APPLICATION

The instant application claims priority to Malaysia Patent Application Serial No. PI2022006759 filed Dec. 1, 2022, the entire specification of which is expressly incorporated herein by reference.

FIELD OF THE INVENTION

The invention relates to packaging processes. More particularly, the invention relates to a packing apparatus and its method for loading articles into packaging, with the articles having been arranged into a stack, and the packaging being an open-ended carton sleeve.

BACKGROUND OF THE INVENTION

In a packaging production line involving compressible articles such as gloves, socks, or the like, these compressible articles are arranged into a stack and loaded into a packaging. The packaging, now loaded with the stack of compressible articles, is then sent to a downstream process for sealing or for further packaging.

However, in conventional packaging production lines, the stack of compressible articles may not be properly loaded into a packaging. This is because there may be air pockets present between or within each compressible article of the stack, thereby bloating the overall dimensions of the stack. As a result, the stack may fail to have the specified quantity of compressible articles as the compressible articles may fall off the stack as the stack is loaded into the packaging, or the stack may crumple the packaging as it is loaded into the packaging.

There are a few disclosed technologies over the prior art related to loading a stack of compressible articles into packaging within packaging production lines. Among them is U.S. Pat. No. 8,650,842, which discloses a glove-packing apparatus for packing gloves into a box, and its corresponding usage method. The glove packing apparatus comprises a receptacle, a floor, and an opening opposite the floor. The receptacle forms a stack of gloves to be packed, and further has a perimeter wall for containing the stack of gloves. The floor is within the perimeter wall and supports the stack of gloves. The opening opposite the floor allows additional gloves to be added during the stacking of gloves. During use, the floor may be moved relatively away from the opening so that gloves are added to the stack of gloves, or relatively towards the opening to remove the stack of gloves from the receptacle. However, this disclosed technology remains plagued by the aforementioned shortcomings as air pockets remain present in the stack of gloves as they are packed or loaded into a box.

Accordingly, it would be desirable to have a packing apparatus and its corresponding method for loading articles, having been arranged into a stack, into a packaging that reduces or eliminates the presence of air pockets present therewithin, as it is loaded into packaging in a packaging process.

SUMMARY OF THE INVENTION

The main objective of the invention is to provide at least a packing apparatus and its corresponding method for loading articles into packaging, with the articles having been arranged into a stack, and the packaging being an open-ended carton sleeve.

To achieve this objective, the invention provides an arm unit acting as a compressing means that compresses the stack to size it sufficiently so that loaded into the packaging with little to no air pockets. This allows the stack to maintain its specified quantity of compressible articles and the packaging to maintain its structural integrity.

The invention intends to provide a packing apparatus for loading articles, having been arranged into a stack, into a packaging, comprising a carrying means for carrying the stack, and a compressing means for collecting the stack from the carrying means and transferring the stack into the packaging through an open end of the packaging. The compressing means is further adapted to compress the stack for sizing it sufficiently so that the stack is loaded into the packaging together with the compressing means.

Preferably, the apparatus further comprises a gripping means adapted to enter an opposing open end of the packaging for gripping a corresponding end of the stack and pulling the stack further into the packaging.

Preferably, the carrying means comprises one or more retractable base supports for supporting the stack, and at least a pair of flaps for vertically straightening the stack supported on the retractable base supports.

Preferably, the compressing means comprises a hoister unit that pushes the stack for lifting it from the carrying means vertically in an upwards direction, and a hemming unit that hems the stack that is lifted by the hoister unit. The hoister unit further pushes the stack against the hemming unit for the stack to be compressed to size it sufficiently.

Preferably, regarding the apparatus, the articles of the stack are compressible articles, and the packaging is an open-ended carton sleeve.

The invention further intends to provide a method for loading articles, having been arranged into a stack into packaging, comprising the steps of carrying the stack, by a carrying means, collecting the stack from the carrying means, by a compressing means, and transferring the stack into the packaging through an open end of the packaging, by the compressing means. The compressing means is further adapted to compress the stack for sizing it sufficiently so that the stack is loaded into the packaging together with the compressing means.

Preferably, the method further comprises the steps of entering a gripping means into an opposing open end of the packaging, gripping a corresponding end of the stack, by the gripping means, and pulling the stack further into the packaging, by the gripping means.

Preferably, the method further comprises the steps of supporting the stack, by one or more retractable base supports of the carrying means, and vertically straightening the stack, by at least a pair of flaps of the carrying means.

Preferably, the method further comprises the steps of lifting the stack from the carrying means, by a push force exerted by a hoister unit of the compressing means, and hemming the stack lifted by the hoister unit, by a hemming unit of the compressing means. The hoister unit further pushes the stack against the hemming unit for the stack to be compressed to size it sufficiently.

Preferably, regarding the method, the articles of the stack are compressible articles, and the packaging is an open-ended carton sleeve.

One skilled in the art will readily appreciate that the invention is well adapted to carry out the objects and obtain the ends and advantages mentioned, as well as those inherent therein. The embodiments described herein are not intended as limitations on the scope of the invention.

BRIEF DESCRIPTION OF THE DRAWINGS

To facilitate an understanding of the invention, there is illustrated in the accompanying drawings the preferred embodiments from an inspection of which when considered in connection with the following description, the invention, its construction and operation and many of its advantages would be readily understood and appreciated.

DETAILED DESCRIPTION OF THE INVENTION

The present invention relates to a packing apparatus and its corresponding method for loading articles into packaging, with the articles having been arranged into a stack, and the packaging being an open-ended carton sleeve. The invention may also be presented in a number of different embodiments with common elements.

According to the concept of the invention, the packing apparatus comprises a loader with a carrier unit acting as a carrying means and an arm unit acting as a compressing means, whereby the arm unit has a hoister unit and a hemming unit that transfers the stack of articles from the carrier unit into packaging while compressing the stack so that it is sized sufficiently to fully enter the packaging with little to no air pockets present therein. The invention will now be described in greater detail, by way of example, with reference to the drawings.

Figure 1:
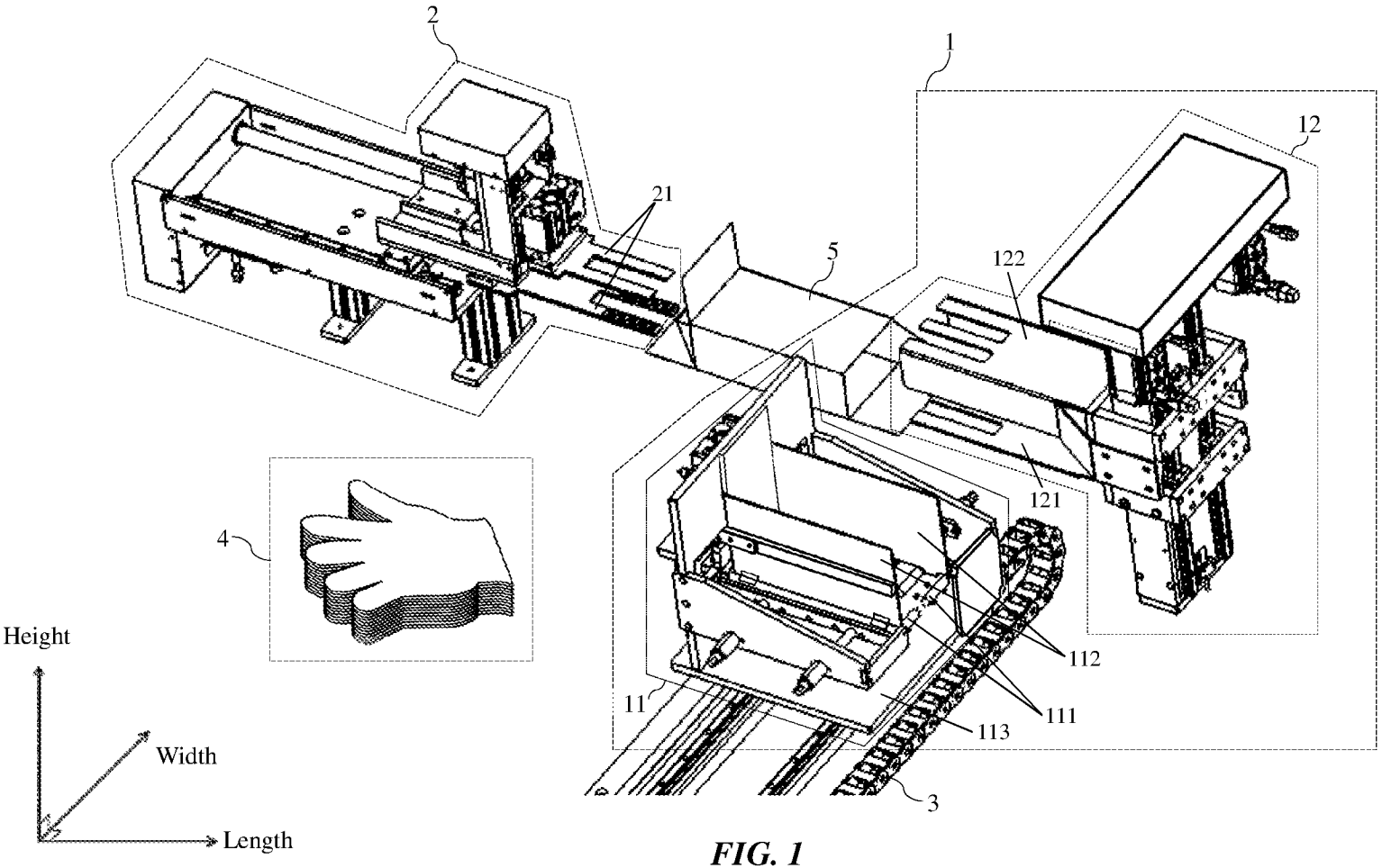
FIG. 1 is a diagram illustrating a first view of the present invention.

FIG. 1 illustrates a first view of the present invention, which includes all of the components/tangible entities involved therein. In particular, there is loader 1 acting as a first loading means, and an ancillary loader 2 acting as a second loading means. The loader 1 further includes a carrier unit 11, which acts as a carrying means, and an arm unit 12, which acts as a compressing means. Preferably, the carrier unit 11 is mounted on a conveyor 3. A stack 4, being a stack of compressible articles, is to be received by carrier unit 11 and transferred into packaging 5 through the use of arm unit 12.

Figure 2:
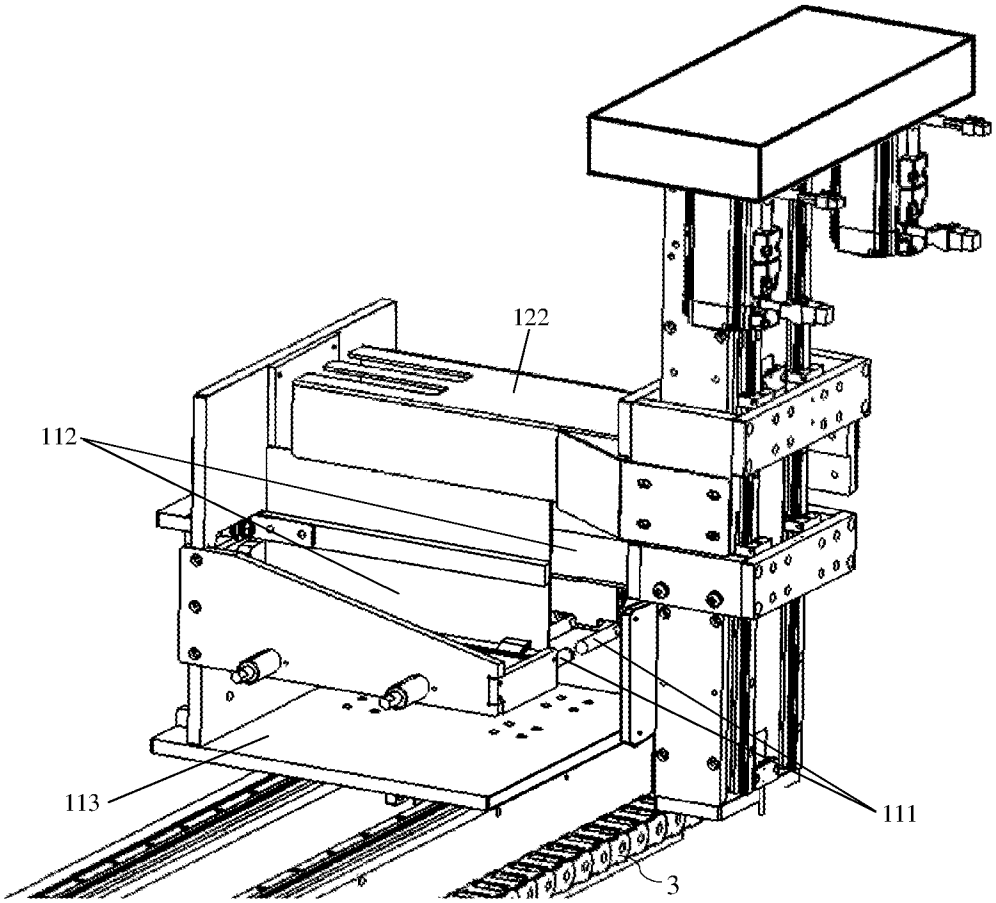
FIG. 2 is a diagram illustrating a second view of the present invention, more specifically, the carrier unit (carrying means) and the arm unit (compressing means).

FIG. 2 is a diagram illustrating a second view of the present invention, more specifically, the carrier unit 11 and the arm unit 12 of loader 1.

Referring to FIG. 1 and FIG. 2, it is shown that the carrier unit 11 further comprises one or more base supports 111 and at least a pair of side flaps 112, whereby both, in combination, support carrying of the stack 4. It is also shown that arm unit 12 further comprises a hoister unit 121 and a hemming unit 122, whereby both, in combination, provide compression and transportation of the stack 4.

Regarding the carrier unit 11, its base supports 111 are preferably one or more rod-like structures located at an elevated position with respect to its base 113. More specifically, the base supports 111 may be divided into two, or more, sets, whereby each set is disposed horizontally along a width of carrier unit 11 and are substantially parallel to each other. Each base support 111 of one set may be aligned with an opposing base support 111 of the other set.

Regarding the carrier unit 11, its base supports 111 are further capable of being extended and retracted to assume either an advanced state or a withdrawn state. To assume the advanced state, each base support 111 of both sets is extended for forming a minimal distance between the facing tips of each base support 111 of both sets. To assume the withdrawn state, each base support 111 of both sets is retracted for forming a maximum distance between the facing tips of each base support 111 of both sets.

Regarding the carrier unit 11, its flaps 112 are preferably a pair of flat structures that are each disposed adjacent to each base support set. More specifically, they are hinged to the carrier unit 11 and are controlled to assume a spread state and an upright state. To assume the spread state, both flaps 112 are moved to form an acute angle with respect to the base supports 111; more specifically, both flaps 112 diverge from each other for a "⌄"-like shape to be formed with respect to the base supports 111. To assume the upright state, both flaps 112 are moved to form a right angle with respect to the base supports 111; more specifically, both flaps 112 are parallel to each other for a "⊔"-like shape to be formed with respect to the base supports 111. Regarding the arm unit 12, its hemming unit 122 is preferably an elongated structure with an inverted groove therealong. More specifically, this structure has a foundational frame as a ceiling with downward extrusions at its lengthened sides that define its walls, thereby forming the inverted groove. Preferably, the hemming unit 122 has a sectional shape that is similar to a "⊓" shape, or any other similar shape.

Regarding the arm unit 12, its hoister unit 121 is preferably a flat structure having a width that is substantially shorter than the sectional width of the hemming unit 122. Furthermore, it is preferable that the hoister unit 121 is below the hemming unit 122.

In particular, both the hoister unit 121 and the hemming unit 122 are operated to perform one or more movements, be it individually or in conjunction. More specifically, the hoister unit 121 may move along one or more axes for it to move into the hemming unit 122 by moving towards an upward direction. Furthermore, as hoister unit 121 is moved to be within the hemming unit 122, both hoister unit 121 and hemming unit 122 may move together in unison along one or more axes.

Regarding the ancillary loader 2, it comprises one or more grippers 21 acting as gripping means. Preferably, it has two grippers 21, with one above the other at a distance. Each gripper 21 is a flat structure and is movable along one or more axes. Both grippers 21 may be operated to perform a gripping function by having either one or both grippers perform a movement that reduces a vertical distance between them.

Regarding the conveyor 3, it functions to carry one or more carrier units 11 and actuate a movement for each carrier unit 11 for it to reach the arm unit 12 or to be away from the arm unit 12. Most preferably, the conveyor 3 is a rail conveyor system whereby it is a sliding rail having a belt driven by a servo motor. Alternatively, conveyor 3 may be a chain conveyor system, or any other conveyor system implementable by a skilled person that provides the aforementioned functions. From hereon, the conveyor 3 may be referred to as rail conveyor 3.

Regarding the stack 4, it is preferably a stack of compressible articles. The stack of compressible articles may be any one or a combination of elastomeric-based items, textile-based items, or any items that exhibit some form of elasticity due to its material composition or due to the presence of one or more air pockets therein. Most preferably, these items include wearables such as gloves (e.g. surgical gloves, nitrile gloves, latex gloves, etc.), socks, or the like. Moreover, regarding the compressible articles having been arranged into a stack, it preferably refers to where each compressible article are layered over each other to form a vertical stack of compressible articles that is stack 4.

Regarding the packaging 5, it is preferably an open-ended carton sleeve. More specifically, the open-ended carton sleeve is an erected box having two opposing open ends. Preferably, the open-ended carton sleeve is of pulp-based material (e.g. paper, cardboard, etc.) or synthetic material (e.g. plastic, etc.) or the likes and has the rigidity to support itself to be in a continuously erected manner.

Figure 3:
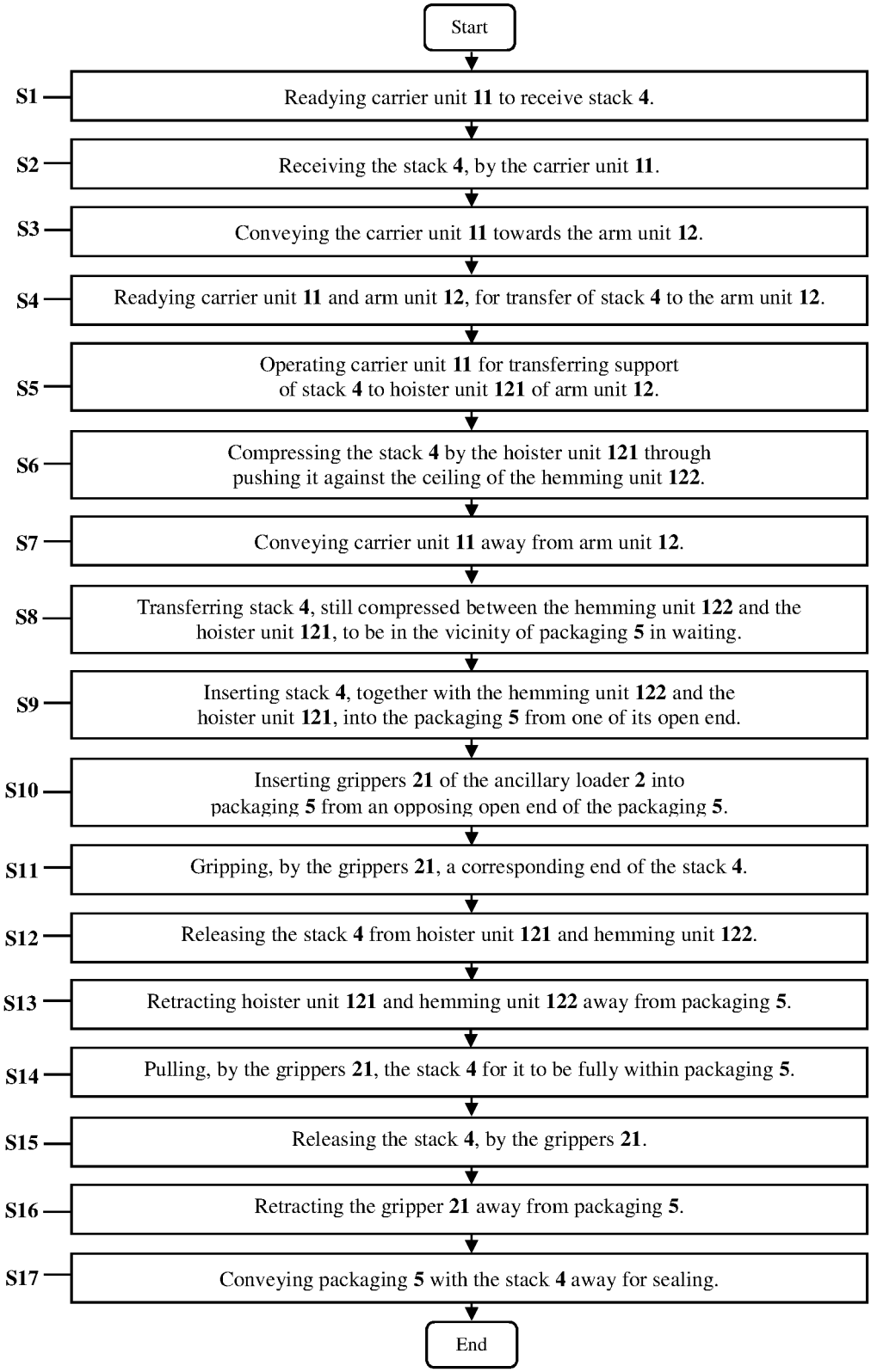
FIG. 3 is a flowchart describing a process flow of the proposed invention whereby articles are loaded into packaging, with the articles having been arranged into a stack, and the packaging being an open-ended carton sleeve.

FIG. 3 is a flowchart describing the loading of stack 4 into packaging 5, with stack 4 being a stack of compressible articles, and packaging 5 being an open-ended carton sleeve. It is noted that the steps described in this flowchart are not to be interpreted as non-limiting, and minor modifications to the steps (e.g. additions, omissions, or swaps) are permissible by a skilled person without substantial deviation from as described. Preferably, the steps described in FIG. 3 are further supported by FIGS. 4*a* to 4*h*, FIG. 5, and FIGS. 6*a* to 6*e*.

FIGS. 4*a* to 4*h* illustrate sectioned side views of the carrier unit 11, the arm unit 12, and stack 4, whereby stack 4 is loaded onto the carrier unit 11 for it to be subsequently transferred to the arm unit 12, as per the steps described in FIG. 3.

Figure 5:
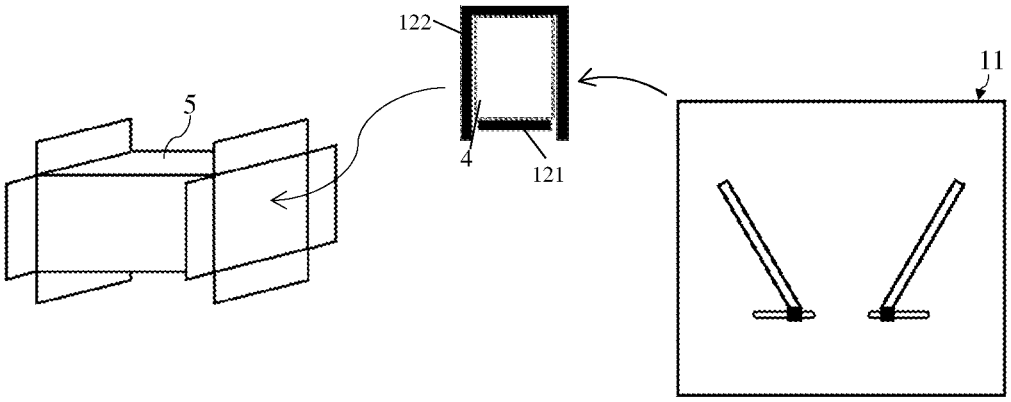
FIG. 5 is a diagram illustrating a transfer of the stack from the carrier unit to an end of the packaging using the arm unit that has the stack compressed within, as per the steps illustrated in FIG. 3.

FIG. 5 illustrates a transfer of stack 4 from the carrier unit 11 into an open end of packaging 5 using the arm unit 12, which has the stack 4 compressed therewithin, as per the steps described in FIG. 3.

FIGS. 6*a* to 6*e* illustrate sectioned top views of the arm unit 12, stack 4, packaging 5, and the grippers 21 of the ancillary loader 2, whereby the stack 4 is fully loaded into packaging 5, as per the steps described in FIG. 3.

Figure 4A:
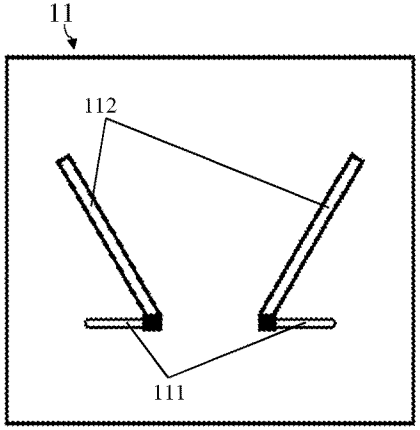
FIGS. 4*a* to 4*h* are a set of diagrams illustrating sectioned side views of the arm unit, carrier unit, and the stack, whereby the stack is loaded onto the carrier unit for it to be subsequently transferred to the arm unit, as per the steps illustrated in FIG. 3.

Prior to the steps described in FIG. 3, the carrier unit 11 may have its base supports 111 assume a withdrawn state and its side flaps 112 assumes a spread state. This is shown in FIG. 4*a*.

Figure 4B:
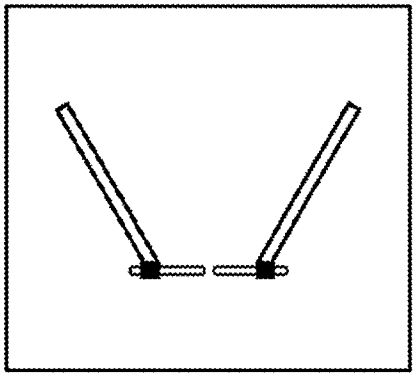

First, in Step S1, carrier unit 11 of loader 1 readied to receive the stack 4. Here, its base supports 111 assume an advanced state and its side flaps 112 assume a spread state. This is shown in FIG. 4*b*.

Figure 4C:
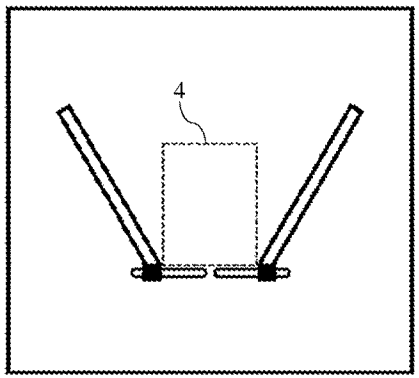
Figure 4D:
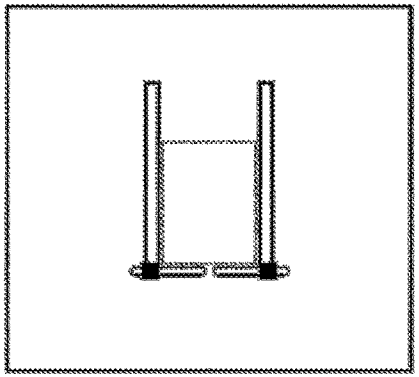

Next, in Step S2, carrier unit 11 receives the stack 4, which is a stack of compressible articles. More specifically, stack 4 is received from a separate device, which may be, by way of example, an end effector of a robot arm. The receipt of stack 4 by the carrier unit 11 is as illustrated in FIG. 4*c*. Upon receiving stack 4, the flaps 112 of the carrier unit 11 immediately assume an erect state for stack 4 to be vertically straightened. This is shown in FIG. 4*d*.

Figure 4E:
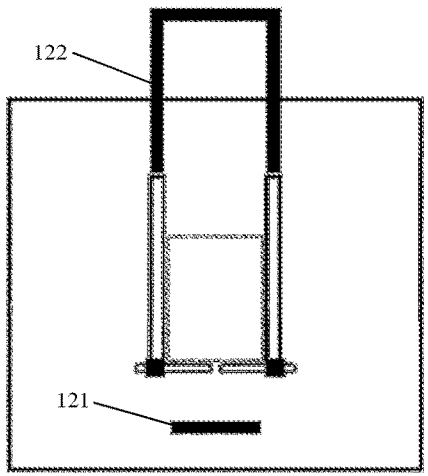

Next, in Step S3, the carrier unit 11 is conveyed towards arm unit 12 using rail conveyor 3 for it to be in the vicinity of arm unit 12. More specifically, the hemming unit 122 of the arm unit 12 is to be located directly above the side flaps 112, while the hoister unit 121 of the arm unit 12 is to be located directly below the base supports 111. This is shown in FIG. 4*e*.

Figure 4F:
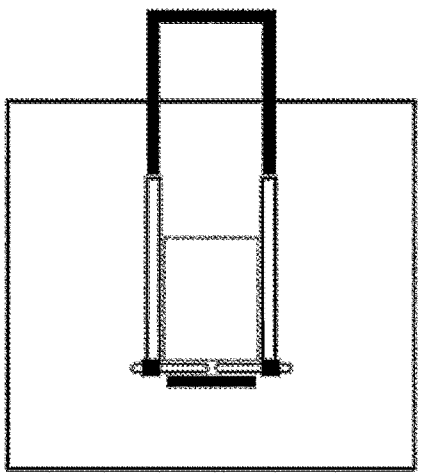

Next, in Step S4, the carrier unit 11 and the arm unit 12 are readied for stack 4 to be transferred into the arm unit 12. Here, the hoister unit 121 of the arm unit 12 travels to the vicinity of the base supports 111 for it to be substantially adjacent to and/or underneath them. This is shown in FIG. 4*f*.

Figure 4G:
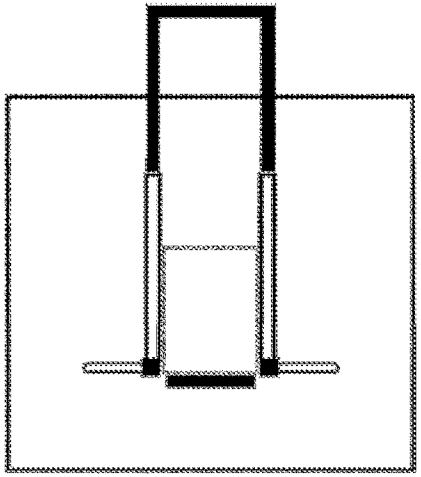

Next, in Step S5, base supports 111 assume a withdrawn state. As such, support of the stack 4 is then transferred from the base supports 111 to the hoister unit 121. This is shown in FIG. 4*g*.

Figure 4H:
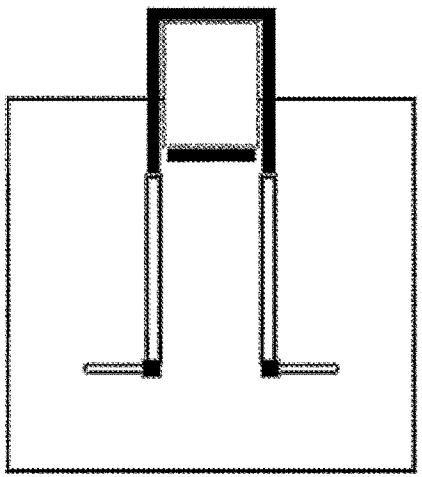

Next, in Step S6, the arm unit 12 is operated for its hoister unit 121 to move vertically in an upwards direction for the hoister unit 121 to exert a push force onto the stack 4 at its base. The push force exerted by hoister unit 121 causes the stack 4 to move vertically in an upwards direction for it to be transferred from carrier unit 11 into hemming unit 122 of the arm unit 12. This is shown in FIG. 4*h*. Here, the stack 4, becomes hemmed within the hemming unit 122, as it is continuously compressed by the hoister unit 121 that continuously pushes it against the ceiling of the hemming unit 122. This sizes the stack 4.

Next, in Step S7, the carrier unit 11 is conveyed away from the arm unit 12 by rail conveyor 3. At this point, the carrier unit 11 may have its side flaps 112 assume a spread state. Next, in Step S8, the stack 4, still compressed between the hoister unit 121 and the hemming unit 122, is transferred to the vicinity of packaging 5 in waiting through simultaneous movements of the hoister unit 121 and the hemming unit 122. These steps Step S6 to Step S8 may be as shown in FIG. 5.

Figure 6A:
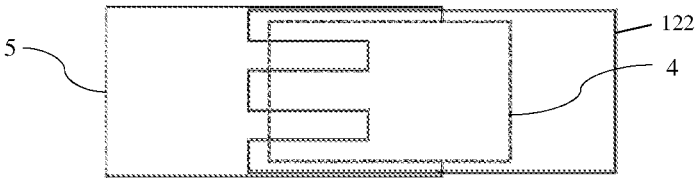
FIGS. 6*a* to 6*e* are a set of diagrams illustrating sectioned top views of the arm unit, the stack, the packaging, and grippers of the ancillary loader, whereby the stack is loaded into the packaging, as per the steps illustrated in FIG. 3.

Next, in Step S9, stack 4, together with the hoister unit 121 and the hemming unit 122, are inserted into packaging 5 from one of its open ends. This is shown in FIG. 6*a*. Preferably, the hemming unit 122, the hoister unit 121, and together with the stack 4 compressed therebetween, in combination, has a lateral dimension that is smaller than the lateral dimension of the open end of packaging 5. This allows for the sized stack 4 to be totally within the packaging 5.

Figure 6B:
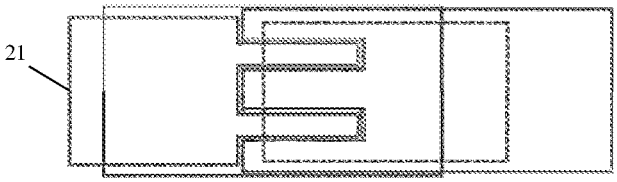

Next, in Step S10, the ancillary loader 2 has its grippers 21 moved and inserted into packaging 5 from an opposing open end of packaging 5. Next, in Step S11, the grippers 21 grip a corresponding end of the stack 4, which is shown in FIG. 6*b*. Preferably, in this step, prongs of the grippers 21 and the hemming unit 122 are interlocked.

Figure 6C:
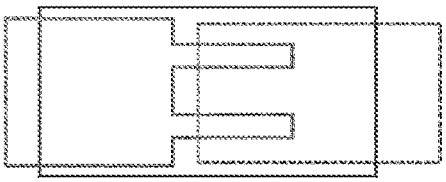

Next, in Step S12, the stack 4 is released from the hoister unit 121 and the hemming unit 122. Next, in Step S13, the hoister unit 121 and the hemming unit 122 are retracted away from packaging 5. With this, the stack 4, or portions thereof, is left within packaging 5 with it still being gripped by grippers 21. This is shown in FIG. 6*c*.

Figure 6D:
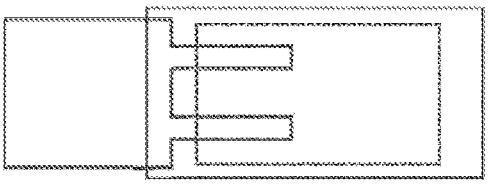

Next, in Step S14, the grippers 21 pull the stack 4 for it to be fully within the packaging 5. This is shown in FIG. 6*d*. With this, as per Step S15, the grippers 21 ungrip stack 4 and release it therefrom.

Figure 6E:
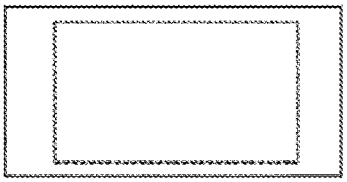

Next, in Step S16, the grippers 21 are retracted away from packaging 5. This results in what is shown in FIG. 6*e*, whereby the stack 4 is now fully within the packaging 5.

Finally, in Step S17, packaging 5, now having the stack 4 therewithin, is indexed away for a tug-in process, a sealing process, or any other relevant downstream packaging processes.

It is noted that there may be a control system that operates each of the components described in FIG. 1 as per the steps described in FIG. 3. In particular, such a control system may be an industrial computer, such as a programmable logic controller (PLC), which schedules and executes software instructions/computer logic instructions instructed by an application software that is programmed accordingly. For further actuating the described components physically, the control system may further incorporate one or more mechanical devices that perform actuating, which may be, by way of example, electric motors, pneumatic pistons, or the like.

With this, the present invention has provided a packing apparatus and its corresponding method for loading stack 4 into packaging 5 that reduces or eliminates the presence of air pockets present within stack 4 as it is loaded into packaging 5 in a packaging process.

The present disclosure includes as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the invention.

What is claimed is:

1. A packing apparatus for loading articles, having been arranged into a stack, into a packaging, comprising:

a carrying means comprising one or more base supports, for carrying and supporting the stack;

a compressing means comprising a hoister unit and a hemming unit, for collecting the stack from the carrying means and transferring the stack into the packaging through an open end of the packaging; and grippers that are configured to move into an opposing open end of the packaging;

wherein the hemming unit includes a horizontally oriented planar surface member having a pair of spaced and opposed sidewall members extending therefrom so as to define a cavity;

wherein the hoister unit includes a horizontally oriented planar surface member;

wherein the hoister unit has a sectional width less than a sectional width of the hemming unit;

wherein the horizontally oriented planar surface member of the hoister unit is operable to be at least partially received within the cavity of the hemming unit;

wherein the base supports retract for allowing support of the stack to be transferred to the hoister unit that is positioned to be adjacent to the base supports, for the hoister unit to transport the stack from the vicinity of the base supports into the hemming unit, with the stack hemmed within the hemming unit while being pushed against the hemming unit by the hoister unit so as to compress the stack into a compressed state for sizing the stack sufficiently, so that the stack remains in the compressed state during transport and is then inserted into the packaging together with the hoister unit and the hemming unit while being continuously maintained in the compressed state;

wherein the grippers grip a corresponding end of the stack, in which the stack is then released from the hoister unit and the hemming unit while still being gripped by the grippers, for the grippers to then pull the stack to be within the packaging.

2. The apparatus according to claim 1, wherein the carrying means further comprises:

at least a pair of flaps for vertically straightening the stack supported on the base supports.

3. The apparatus according to claim 1, wherein:

the hoister unit pushes the stack for lifting the stack from the vicinity of the base supports vertically in an upwards direction; and the hemming unit hems the stack that is lifted by the hoister unit.

4. The apparatus according to claim 1, wherein:

the articles of the stack are compressible articles; and the packaging is an open-ended carton sleeve.

5. A method for loading articles, having been arranged into a stack, into a packaging, comprising the steps of:

carrying and supporting the stack, by a carrying means comprising one or more base supports;

collecting the stack from the carrying means, by a compressing means comprising a hoister unit and a hemming unit;

wherein the hemming unit includes a horizontally oriented planar surface member having a pair of spaced and opposed sidewall members extending therefrom so as to define a cavity;

wherein the hoister unit includes a horizontally oriented planar surface member;

wherein the hoister unit has a sectional width less than a sectional width of the hemming unit;

wherein the horizontally oriented planar surface member of the hoister unit is operable to be at least partially received within the cavity of the hemming unit;

transferring the stack into the packaging through an open end of the packaging, by the hoister unit and the hemming unit; and moving grippers into an opposing open end of the packaging;

wherein the base supports retract for allowing support of the stack to be transferred to the hoister unit that is positioned to be adjacent to the base supports, for the hoister unit to transport the stack from the vicinity of the base supports into the hemming unit, with the stack being hemmed within the hemming unit while being pushed against the hemming unit by the hoister unit so as to compress the stack into a compressed state for sizing the stack sufficiently, so that the stack remains in the compressed state during transport and is then inserted into the packaging together with the hoister unit and the hemming unit while being continuously maintained in the compressed state;

wherein the grippers grip a corresponding end of the stack, in which the stack is then released from the hoister unit and the hemming unit while still being gripped by the grippers, for the grippers to then pull the stack to be within the packaging.

6. The method according to claim 5, further comprising the steps of:

supporting the stack, by the base supports of the carrying means; and vertically straightening the stack, by at least a pair of flaps of the carrying means.

7. The method according to claim 5, further comprising the steps of:

lifting the stack from the carrying means, by a push force exerted by the hoister unit of the compressing means; and hemming the stack lifted by the hoister unit, by the hemming unit of the compressing means.

8. The method according to claim 5, wherein:

the articles of the stack are compressible articles; and the packaging is an open-ended carton sleeve.

* * * * *